United States Patent [19]

Nagahisa

[11] Patent Number: 5,018,721

[45] Date of Patent: May 28, 1991

[54] SLIDING DEVICE

[76] Inventor: Kouichi Nagahisa, 2-37, Ekinan 4-chome, Takaoka-shi, Toyama-ken 933, Japan

[21] Appl. No.: 481,170

[22] Filed: Feb. 20, 1990

[30] Foreign Application Priority Data

| | | | |
|---|---|---|---|
| Feb. 20, 1989 | [JP] | Japan | 64-39719 |
| May 15, 1989 | [JP] | Japan | 64-120838 |
| Jun. 19, 1989 | [JP] | Japan | 64-156138 |
| Aug. 23, 1989 | [JP] | Japan | 64-216270 |
| Aug. 25, 1989 | [JP] | Japan | 64-219598 |
| Oct. 23, 1989 | [JP] | Japan | 64-275362 |

[51] Int. Cl.[5] ..... A63G 21/00

[52] U.S. Cl. ..... 272/56.5 SS; 428/15; 428/58; 428/92

[58] Field of Search ..... 272/56.5 R, 56.5 SS; 428/15, 17, 44, 45, 87, 89, 92, 58

[56] References Cited

U.S. PATENT DOCUMENTS

| | | | |
|---|---|---|---|
| 2,550,078 | 5/1951 | Gaylor | 272/56.5 SS |
| 3,422,732 | 1/1969 | York | 272/56.5 SS |
| 3,473,483 | 10/1969 | York | 272/56.5 SS |
| 4,179,539 | 12/1979 | Schweizer | 272/56.5 SS |

*Primary Examiner*—Richard E. Chilcot, Jr.

*Attorney, Agent, or Firm*—Flynn, Thiel, Boutell & Tanis

[57] ABSTRACT

There are disclosed several sliding devices. One sliding device comprises a sheet mounted on a slope and having a descending substrate, a plurality of recesses arranged uniformly on the substrate, a plurality of balls engaged in the recesses for supporting the ski and rotatable in full directions, the plurality of balls being exposed over the substrate so that the ski contacts the balls, and projecting edges provided at peripheries of the recesses on the substrate for preventing the plurality of balls from getting out from the recesses.

9 Claims, 7 Drawing Sheets

SLIDING DEVICE

BACKGROUND OF THE INVENTION

1. Field of the Invention

The present invention relates to a sliding, device, more particularly to the sliding device such as fur use on an artificial ski slope for ski descending practice, and those mounted on the ski, sleigh, skate board.

2. Description of Prior Art

If artificial snow is used on the artificial ski slope, it costs much for producing the artificial snow and installing air conditioners so that the artificial ski slope having an artificial lawn thereon (hereinafter referred to as artificial lawn ski slope) has become a main current for ski descending practice.

The artificial lawn ski slope comprises an artificial lawn layed on the slope. A descending sheet (mounted on the slope (hereinafter referred to as sheet) has the artificial lawn made of flexible or rigid plastic fiber implanted thereon. The people (hereinafter referred to as player) can ski smoothly on the artificial lawn ski slope since the slide and the cushion necessary for descending is obtained between the artificial lawn ski slope and a pair of skis (hereinafter simply referred to as ski).

A sliding surface of a prior art sliding device of such as a ski is formed flat so as to slide on the snow slope or the artificial ski slope provided with a direction restricting groove along the center of the width direction thereof. A prior art sleigh is generally provided with the sliding surface of the same structure set forth above. Prior art skate boards (hereinafter referred to as simply skate board) have rollers corresponding to the wheels, which are supported by shafts provided at the bottom surface thereof so as to rotate forward and backward.

The prior art sliding device formed of conduit shape typically comprises an inclined flat bottom plate, and side plates or frames protruded from the bottom plate at both sides thereof. The player sits on the sliding device and grips the side frames while sliding on the slope.

There has been proposed the sliding device comprising the bottom plate having a plurality of rollers uniformly arranged thereon. This sliding device utilizes a sliding friction generated between the rollers and the slope. The rollers are supported, like beads on an abacus, by a plurality of shafts arranged laterally on the bottom plate or accommodated in a plurality of recessed holes provided at the bottom plate thereof.

However, there are the following problems in the prior art sliding device. Firstly, inasmuch as the ski slides against a sliding friction between the ski and the lawn there produces considerable high frictional heat for thereby melting the lawn whereby the melted lawn is attaChed to the ski. Accordingly, the artificial lawn is soon damaged at the place where frequent descending occurs, and hence the lawn must often be replaced by a new one. Due to melting of the artificial lawn, the descending speed is restrained, differing from on the natural snow slope so that the desired speed can not be obtained.

Secondly, inasmuch as the artificial lawn is liable to reduce the descending speed, the artificial ski slope is sharply inclined to obtain high descending speed which involves damage to the artificial lawn, although the natural snow slope is melted at its surface and provides very low friction between the ski and the thin layer of melted snow so that the player can descend on the natural snow slope at high speed.

In the case of the prior art ski or the sleigh, the player can not slide on the ski without the natural snow on the natural ski slope and it costs much for installing the artificial lawn facilities since the plastic fiber is implanted on the sliding sheet and the thus implanted sliding sheet is worn or melted by the frictional heat generated between the ski and the sliding sheet. Hence, the sleigh and the sliding sheet involve less durability and high cost for maintenance thereof.

On the other hand, in the case of the prior art skate board, if the rollers are simply supported by the shafts, the player feels an inferior cushion which makes the player uncomfortable. When the shafts supporting the rollers are urged by springs for obtaining better cushion, the structure is complicated, and the player is liable to be involved in accidents and feels unbalanced and unstable.

In the case of the sliding device having a flat bottom plate, the hip is heated during descending action due to the frictional heat and the desired speed can not be obtained because of the frictional heat unless the slope is sharply inclined. If the slope is shaply inclined, the danger is increased during the descending action which involves the difficult assurance of safety.

In the case of the prior art sliding device having the rollers provided at the bottom plate (hereinafter referred to as roller type), a considerable high speed can be obtained even on the gentle slope, which assures the safety but there is a likelihood of danger that the rollers are caught in the parts of the wear. Furthermore, since the hip strikes strong against the corner of the roller which permits the player to feel pain at their hips, there is a problem that comfortable descending can not be obtained. Still furthermore, the roller type is difficult to use when the descending surface on the slope is curved relative to the width direction of the slope and both sides of the slope are gradually elevated. Hence, in the roller type, both sides of the slope are elevated stepwise in the an unnatural manner.

More still furthermore, in the roller type, the guiding direction due to the rotation of the roller is restricted by the rotary direction thereby making turns difficult. Hence, the design of a curved and variable course is restricted. Even if the slide is so designed that the player can readily turn on the slope with his own intention, and the slope is wider like the ski slope, it is difficult to turn the sliding direction without applying force to the rollers with might and main. There is a danger of falling down on the slope if the player applies the force on the slide with might and main.

SUMMARY OF THE INVENTION

The present invention has been made in view of the problems set forth above.

That is, the inventor carried out various experiments and discovered that rolling friction is generated at the sliding of the ski if a plurality of balls are rotatably held on the slope which is extremely similar to the natural snow slope.

It is an object of the present invention to provide an artificial ski slope, on which the player can descend, utilizing rolling friction without generating frictional heat whereby desired slalom and descending speed can be obtained like a natural ski slope.

The other objects correspond to the advantages set forth in the following description. Hence, the explanation thereof is omitted.

To achieve the objects of the present invention, the sliding device comprises a sheet mounted on a slope and having a descending substrate, a plurality of recesses arranged uniformly on the substrate, a plurality of balls engaged in the recesses for supporting the ski and rotatable in full directions, the plurality of balls being exposed over the substrate so that the ski contacts the balls, and projecting edges provided at peripheries of the recesses on the substrate for preventing the plurality of balls from getting out from the recesses.

The above and other objects, features and advantages of the present invention will become more apparent from the following description taken in conjunction with the accompanying drawings.

PREFERRED EMBODIMENT OF THE PRESENT INVENTION

Figure 1:
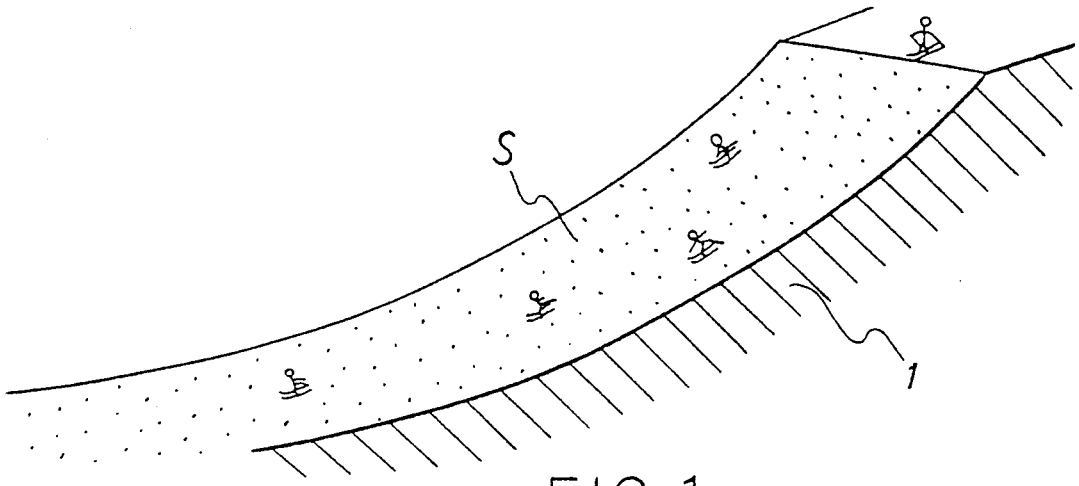
FIG. 1 is a perspective view of a sliding device according to a first embodiment of the present invention.
Figure 2:
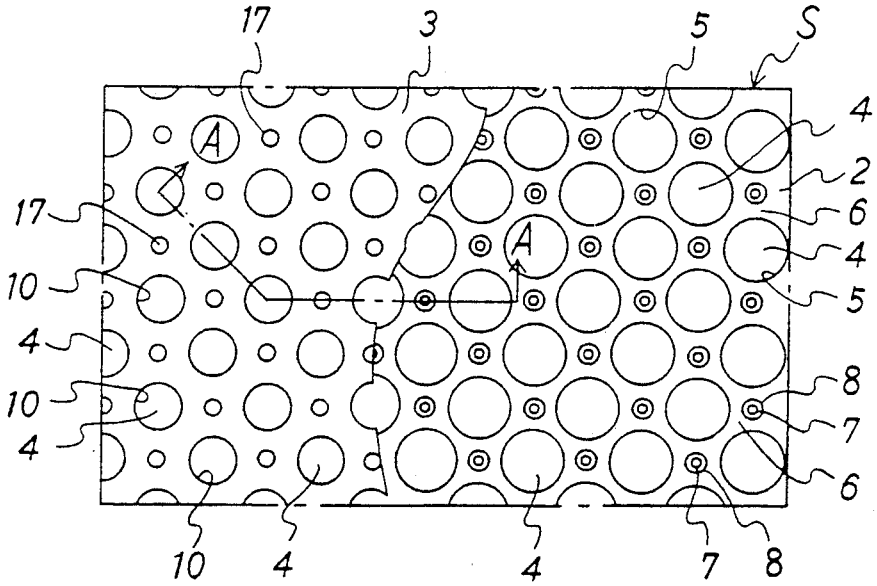
FIG. 2 is a partly cut out plan view showing a descending sheet employed in the first embodiment.
Figure 3:
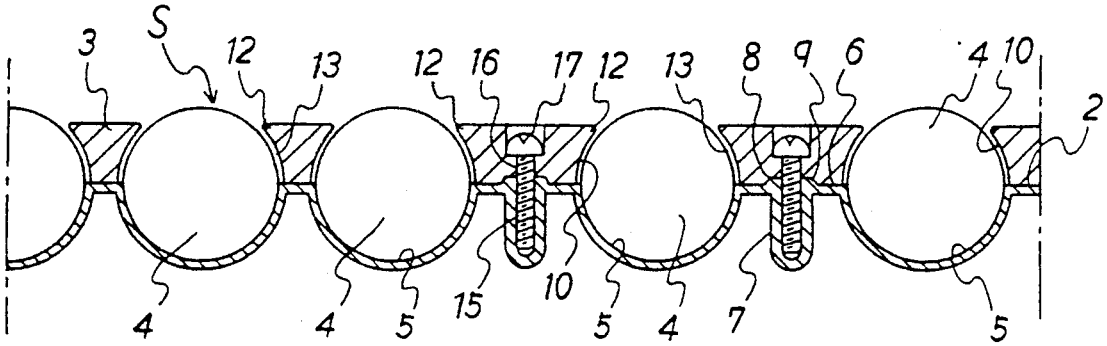
FIG. 3 is an enlarged cross section taken along A—A of FIG. 2.

First Embodiment (FIGS. 1 to 3)

An artificial ski slope as the sliding device according to a first embodiment of the present invention will be described with reference to FIGS. 1 to 3.

The artificial ski slope located outdoors utilizes the slopes in mountains, hills and parks which are defined as a slope 1. The slope 1 can be formed by a frame. A sheet S is layed on the slope 1. The sheet S comprises a substrate 2, a presser plate 3 and a plurality of balls 4. The substrate 2 is made of rigid plastics and has a plurality of recesses 5, 5 . . . defined thereon by recessing thereof hemispherically at an angle of 45°. Inasmuch as the substrate 2 has wide planes 6 surrounded by the plurality of recesses 5, 5 . . . , internal threads 7 are provided at the central portions of the wide planes 6 and the internal threads 7 are projected downward. Tenons 8 are formed projected from the wide planes 6 at the peripheries of the internal threads 7.

The presser plate 3 having a large thickness is made of a synthetic rubber and ejecting holes 10 having a diameter slightly greater than the diameter of the balls 4 are provided in corresponding telation-ship to each recess 5 on the substrate 2. Projecting edges 12 are provided at the peripheries of the opening of the recesses 5 on the substrate 1 so as to narrow the opening of the recesses 5. Projecting edges 12 are formed along imaginary spherical balls, namely, the inner surface of each ejecting hole 10 is defined by an imaginary spherical ball. Inasmuch as the imaginary spherical balls are larger than the balls 4, clearances 13 are defined between the inner surfaces of the ejecting holes 10 and the outer surfaces of the balls 4. Provided on the presser plate 3 at the portions corresponding to the internal threads 7 are holes 16 through which small screws 15 are screwed. There are defined houses 17 at the upper ends of the holes 16 to accommodate the screw heads of the small screws. The presser plates 3 have mortises 9 at the lower portions thereof around the peripheries of the holes 16 for engaging with the tenons 8.

Although the presser plates 3 are fastened to the upper surfaces of the substrate 2 by the small screws 15, the presser plates 3 are accurately positioned by the engagement between the tenons 8 and the mortises 9 and the clearances 13 between the balls 4 and the ejecting holes 10 are kept constant.

Since the screw heads of the small screws 15 are visible from the upper portion thereof after completion of the assembly of the presser plates 3 and the balls 4 on the substrate 2, it is desirable to introduce an adhesive resin liquid into the houses 17 and seal the screw heads in the houses 17 so that the screw heads can not be viewed.

The balls 4 are made of compound vulcanized rubber mixed with carbon black for eliminating static electricity. The balls 4 are formed spherically substantially the same as the recesses 5 so as to contact the inner surfaces of the recesses 5. A part of each ball 4 is projected from the upper surface of each presser plate 3.

When the assembled sheet S is layed on the slope 1, the assembled sheet S is merely placed on the upper surface of the slope after the slope is levelled. The assembled sheet S can not be slipped down along the inclination of the slope, even if it is merely placed on the slope 1, since the uneven portions such as recesses 5 and projections in which the internal threads 7 are formed bite into the slope 1.

When the player makes the ski descending practice on the artificial ski slope having such arrangement set forth above, the thrust toward the inclination direction caused by gravity is transmitted from the ski to the balls 4 for thereby rotating the balls 4 whereby the player can descend.

Although the most parts of the balls 4 are housed in the recesses 5, the balls 4 are rotatable with ease in the recesses 5 because of the clearances 13 and friction is not generated between the ski and the balls 4 whereby the balls 4 do not resist against the thrust of the ski. Hence, it is possible to descend at high speed. Furthermore, no frictional heat is generated between the ski and the balls 4 since there is generated rolling friction therebetween.

Figure 4:
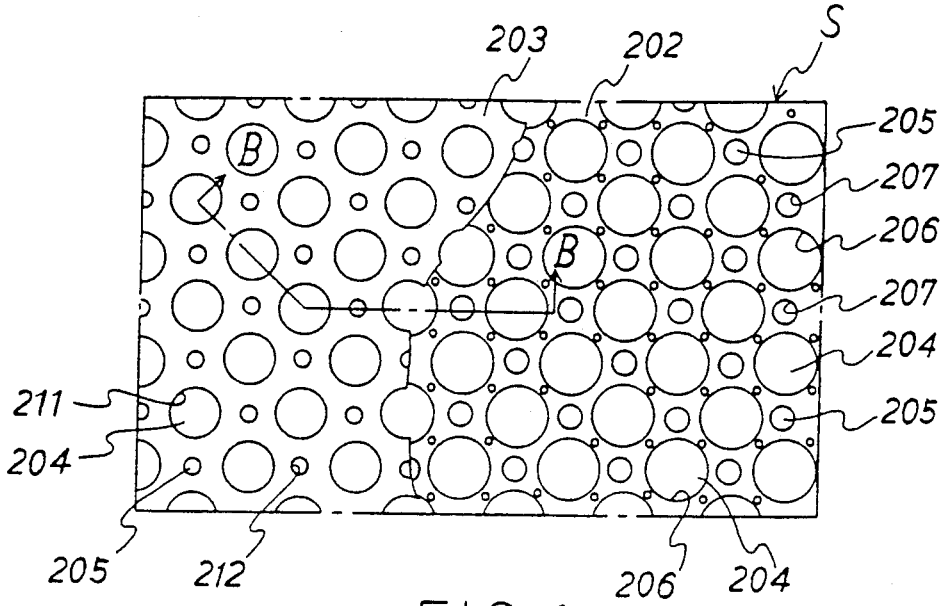
FIG. 4 is a partly cut out plan view showing a descending sheet employed in a second embodiment.
Figure 5:
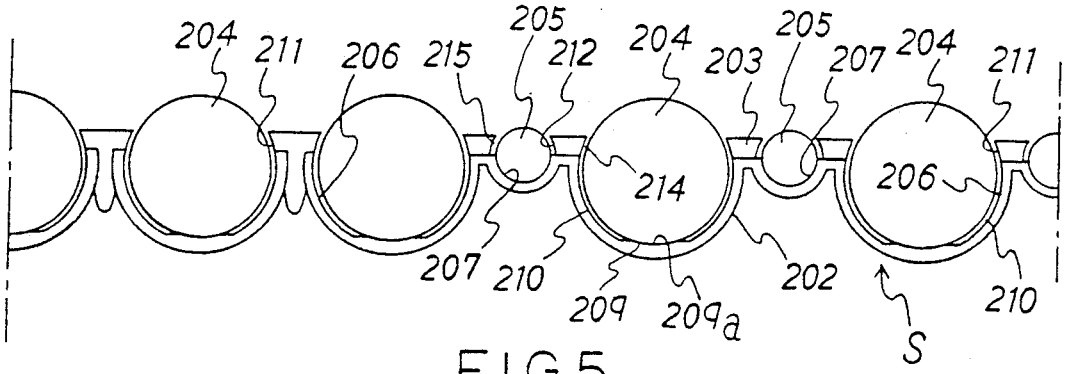
FIG. 5 is an enlarged cross section taken along B—B of FIG. 4.

Second Embodiment (FIGS. 4 and 5)

The sliding device according to a second embodiment will be described with reference to FIGS. 4 and 5.

The substrate 202 is made of rigid plastics and is recessed hemispherically to form recesses 206, 207 in which large and small balls 204, 205 are rotatably engaged. As shown in FIG. 4, the diameter of the balls 204 is significantly greater than the diameter of the balls 205. The recesses 206 in which the large balls 204 are engaged are arranged in the direction of 45° and the recesses 207 in which the small balls 205 are engaged are arranged in the middle of the substrate portions positioned above, below, right and left (FIG. 4) of the recesses 206.

Each recess 206 has a receiving portion 209 on which each large ball 204 is placed. Clearance 210 is defined between the inner surface of the recess 206 and the large ball 204. The receiving portion 209 has a very small recess 209*a* in which part of each large ball 204 is engaged and each large ball 204 is rotatable about the part thereof engaged in the recess 209*a*. Hence, the frictional resistance generated at the time of rotation of each large ball 204 is very small so that the inner surface of each recess 206 serves as the guide of each large ball 204. Accordingly, each large ball 204 smoothly rotates in each recess 206.

On the other hand, each small ball 205 is rotatably engaged in each recess 207 so as to be brought into contact with the inner surface of each recess 207 so that the relatively greater frictional resistance is generated between each small ball 205 inner surface of each recess 207.

The presser plate 203 made of semi-rigid synthetic rubber and formed in large thickess has ejecting holes 211, 212 corresponding to the recesses 206, 207 in the manner that the ejecting holes 211, 212 are formed along an imaginary ball, namely, the inner surface of each ejecting hole 211, 212 is defined by the imaginary ball. Hence, the ejecting holes 211, 212 are defined to narrow the opening diameters of the recesses 206, 207.

However, the imaginary balls along which the ejecting holes 211, 212 are formed are defined to be larger than the large and the small balls 204, 205, so that there are defined clearances 214, 215 between the inner surfaces of the ejecting holes 211, 212 and the large and the small balls 204, 205.

Third Embodiment (FIGS. 6 to 10)

The sliding device according to a third embodiment will be described with reference to FIGS. 6 to 10.

Figure 6:
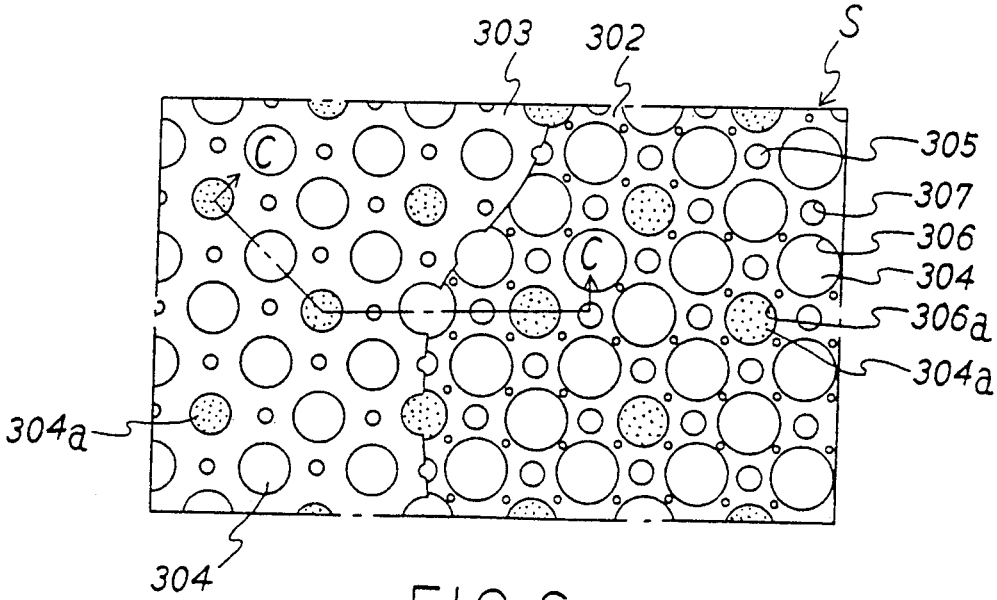
FIG. 6 is a partly cut out plan view showing a descending sheet employed in a third embodiment.
Figure 7:
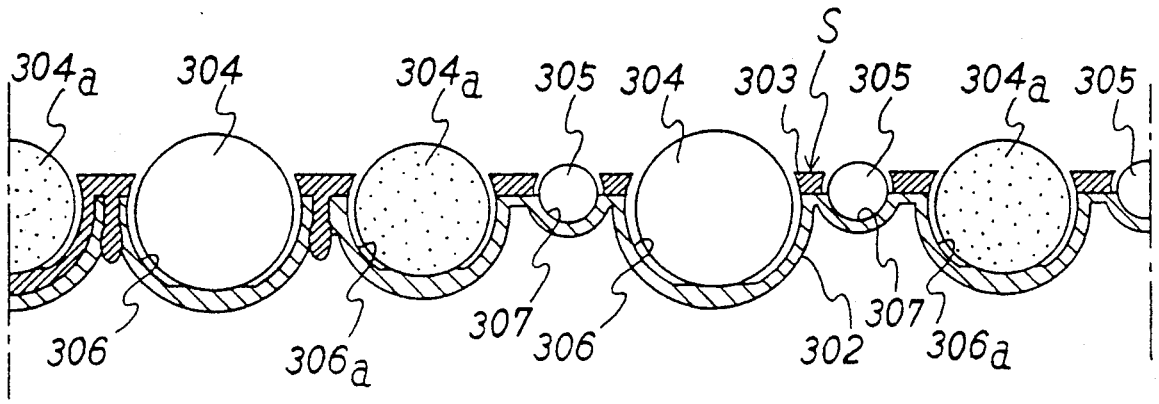
FIG. 7 is an enlarged cross section taken along C—C of FIG. 6.

The substrate 302 is provided with a plurality of recesses 306, 306*a*, 307 in which large, middle and small size balls 304, 304*a*, 305 are rotatably engaged. The receses 306, 306*a* are regularly arranged at the angle of 45° and the recesses 307 are arranged above, below, right and left of the recesses 306, 306*a* midway between the adjacent recesses 306, 306*a*. Hence, the recesses 307 are also regularly arranged at the angle of 45°. The arrangement of the large and the middle size balls 304, 304*a* are illustrated in FIG. 6 in the manner that the middle balls, 304*a* are arranged aslant at the angle of 45° and vertically and laterally alternately relative to the large balls 304.

The middle balls 304*a* made of semi-rigid plastics have a relatively greater rotational frictional resistance caused between the inner surfaces of the recesses 306*a* and the middle balls 304*a*, hence the rotation thereof is restricted more than that of the large balls 304. The recesses 307 with which the small balls 305 are brought into contact and rotatably engaged in have also relatively greater rotational frictional resistance, hence the rotation thereof is also restricted.

The relation between the large, the middle, and the small balls is described more in detail.

The height of the large balls 304 exposed from the substrate 302 is higher than the middle balls 304*a*, and the middle balls 304*a* are higher than the small balls 305. As far as the player makes a schussing ski the ski slides only on the large balls 304 having the least frictional resistance for thereby descending at high speed. When the schussing is turned to the traversing, the ski slides on the middle and the small balls 304*a*, 305 having respectively greater resistance for thereby reducing the sliding speed whereby the turn can be made with ease like on the natural snow slope. In making the traversing, the speed is appropriately reduced.

As is well known, the crystal structure of the snow is similar to a pyramidal structure. The arrangement of the large, middle, and small balls 304, 304*a*. 305 forms the linked pyramidal structure so that the player can feel as if he slided on the natural snow slope.

Figure 8:
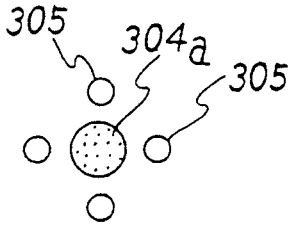
FIGS. 8 to 10 are views of assistance in explaining structures and arrangements of the balls having large, middle and small diameters respectively employed in the third embodiment.
Figure 9:
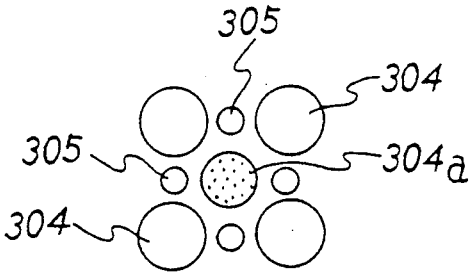
Figure 10:
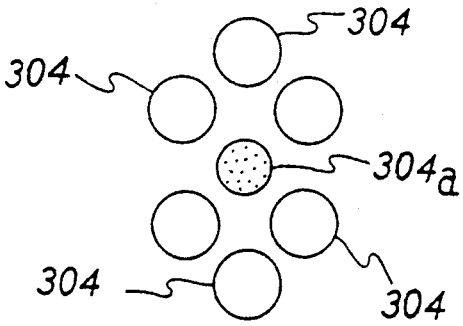

FIGS. 8 to 10 are views illustrating the pyramidal structures respectively selected from those illustrated in FIG. 6. FIG. 8 shows a regular pyramidal structure in which the small balls 305 are arranged around the middle balls 304*a*. FIGS. 9 and 10 show reversed pyramidal structures in which the large balls 304 are arranged around the middle balls 304*a*.

Fourth Embodiment (FIGS. 11 to 14)

The sliding device according to a fourth embodiment will be described with reference to FIGS. 11 to 14.

Figure 11:
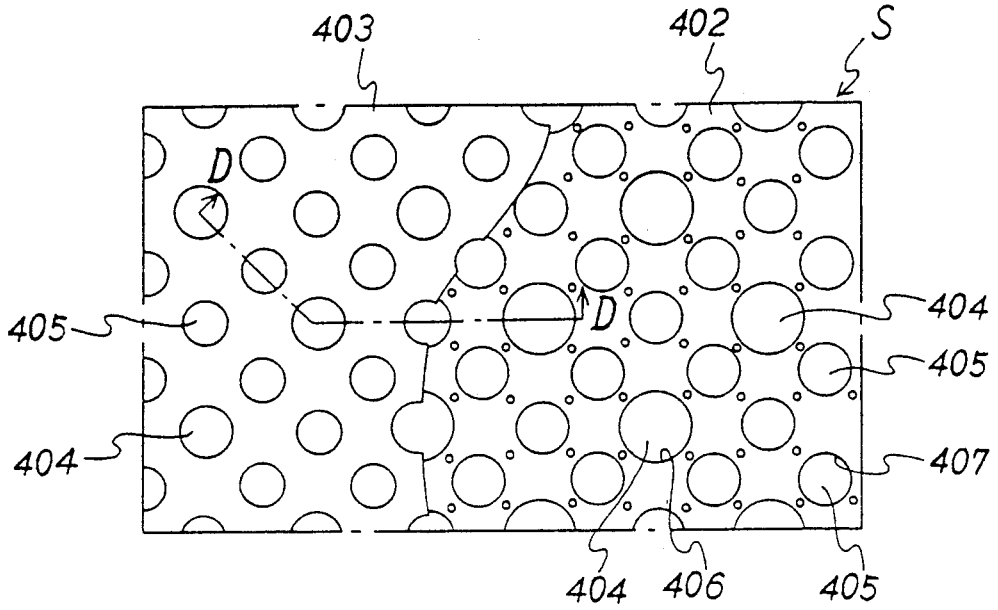
FIG. 11 is a partly cut out plan view showing a descending sheet in a fourth embodiment.
Figure 12:
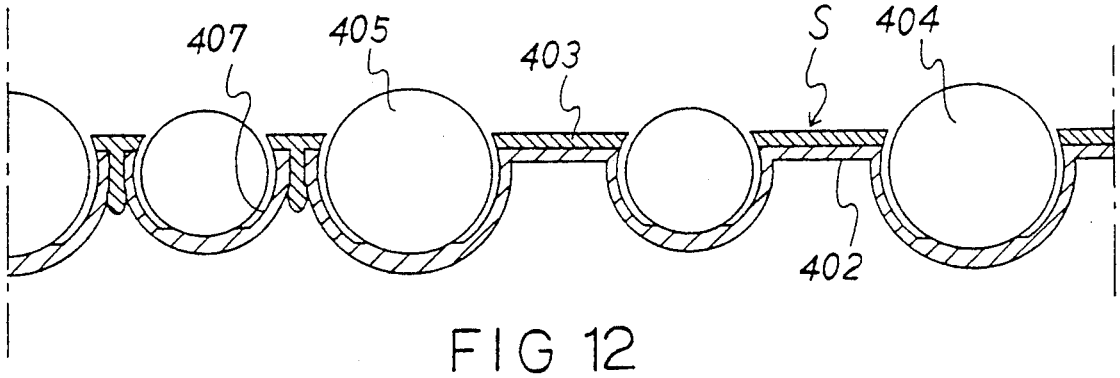
FIG. 12 is an enlarged cross section taken along D—D of FIG. 11.
Figure 13:
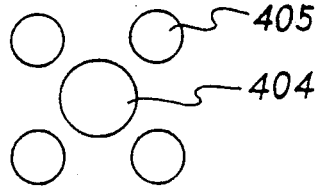
FIGS. 13 and 14 are views of assistance in explaining structures and arrangements of the balls having large and middle diameters respectively employed in the fourth embodiment.
Figure 14:
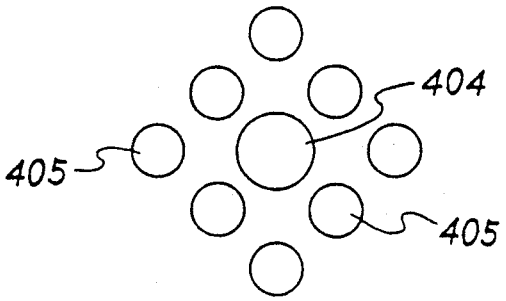
Figure 15:
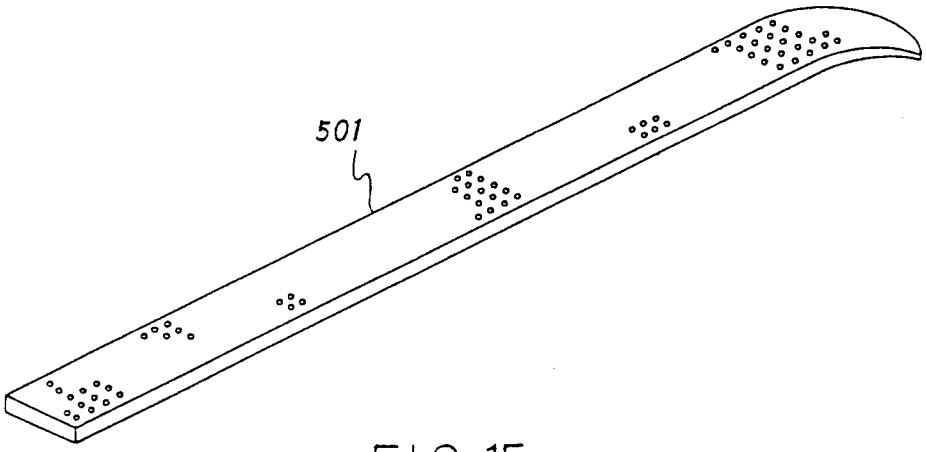
FIG. 15 is a perspective view of a ski as a sliding device according to a fifth embodiment of the present invention.

A substrate 402 has recesses 406, 407 in which large and middle size balls 404, 405 are rotatably engaged. The recesses 406, 407 are arranged regularly, vertically, laterally and aslant at the angle of 45°. The arrangement of the large and the middle size balls 404, 405 is illustrated in FIG. 11 in which the large balls 404 are separated by the middle balls 405 interposed therebetween and arranged alternately therewith. More in detail, the pyramidal structure is illustrated in FIG. 13 in which four middle balls 405 are arranged around one large ball 404. Another pyramidal structure is illustrated in FIG. 14 in which eight middle balls 405 are arranged around one large ball. When the player slides on the artificial ski slope having the arrangement according to the fourth embodiment, the ski is placed and slides on the large balls 404 in making the schussing. However, if the player turns the ski for traversing, then the ski is often placed on the middle balls 405 for thereby subjecting the ski to the various changes.

Fifth Embodiment (FIGS. 15 to 18)

The sliding device according to a fifth embodiment will be described with reference to FIGS. 15 to 18.

A sliding device according to the fifth embodiment comprises a ski 501 and a plurality of large and middle size balls 502, 503 provided at the lower portion thereof. The ski 501 has a wooden body 504 constituting a main portion thereof, a holding substrate 505 and a liner 506, the holding substrate 505 and the liner 506 are respectively adhered to the lower surface of the wooden body 504 for holding the large and middle size balls 502, 503.

Figure 16:
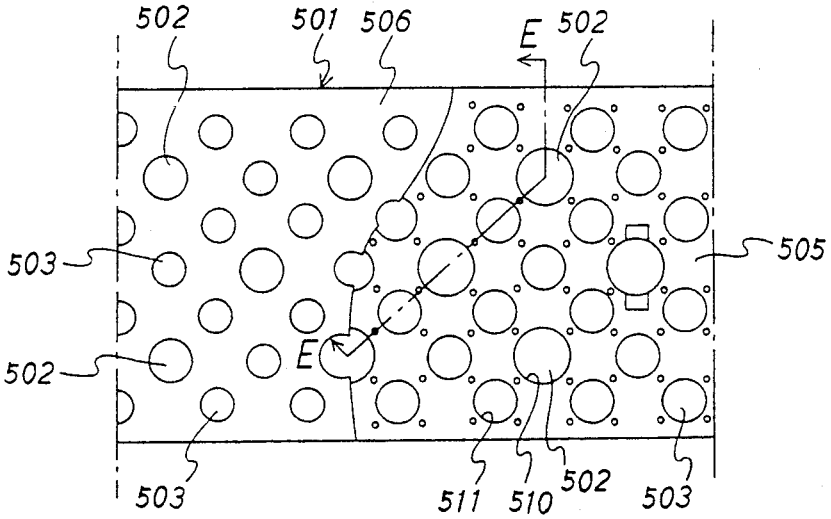
FIG. 16 is a partly cut out plan view showing a descending sheet employed in the fifth embodiment.
Figure 17:
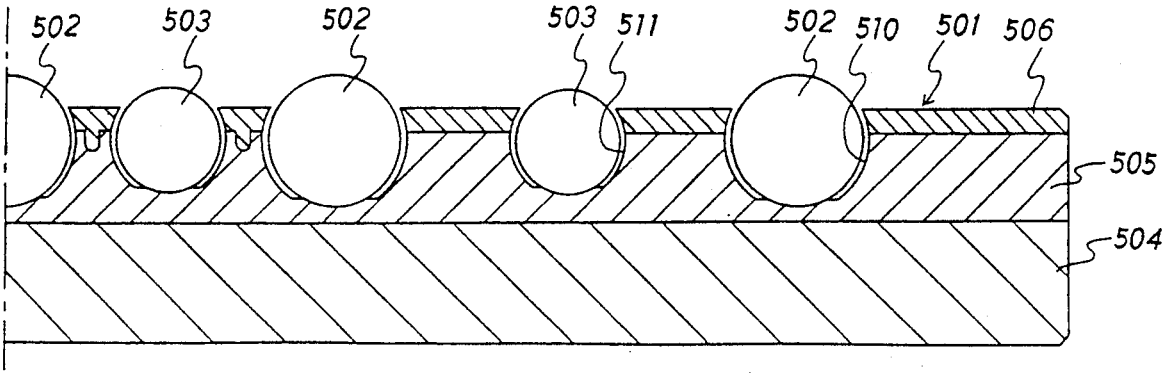
FIG. 17 is an enlarged cross section taken along E—E of FIG. 16.
Figure 18:
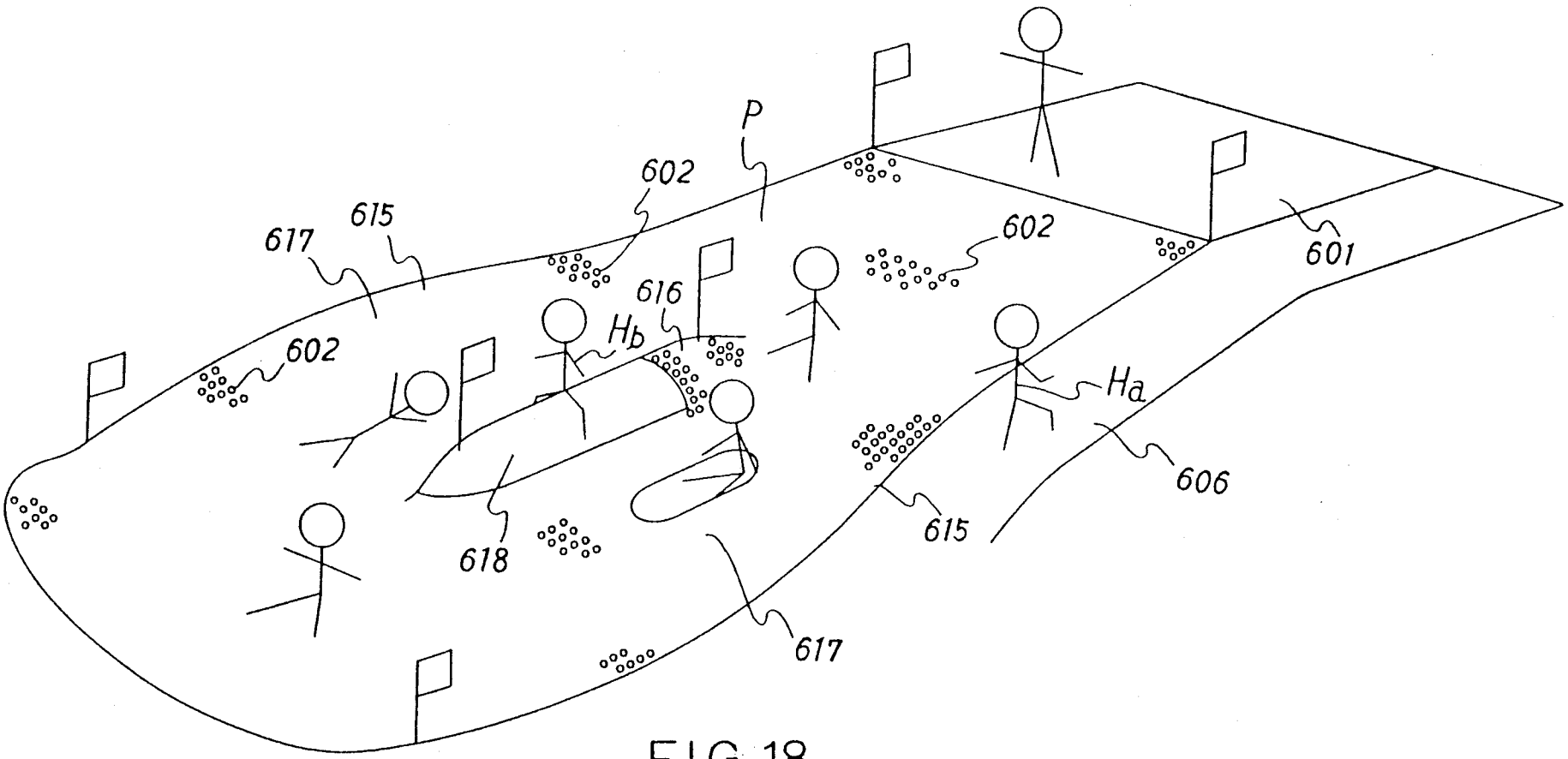
FIG. 18 is a perspective view of a sliding device according to a sixth embodiment of the present invention.

The holding substrate 505 made of rigid plastics is recessed hemispherically at the lower portion thereof for forming recesses 510, 511 in which the large and the middle balls 502, 503 are engaged. The spherical recesses 510, 511 are arranged vertically, laterally and aslant at the angle of 45°. The arrangement of the large and the middle balls 502, 503 is illustrated in FIG. 16 in which the large balls 502 are alternately arranged with middle size balls interposed therebetween vertically, laterally and aslant.

In the case that the sliding device employed is a skate board, the sliding surface may be the one set forth above or a plate made of rigid plastic or covered by a wooden plate, or concrete.

Sixth Embodiment (FIGS. 18 to 21)

A sliding device according to a sixth embodiment will be described with reference to FIGS. 18 to 21.

The sliding device comprises a descending plate P having a gentle inclination of the angle 5 to 30° provided under a play area 601, free balls 603, large and small restricting balls 604, 605 arranged respectively on the sliding plate P and an ascending plate 606 through which the player Ha who completed the descending practice returns to the play area 601. The descending plate P comprises a substrate 608 and an upper sheet 609 adhered to the substrate 608 and elevated gradually at the both sides thereof 615, 615 for forming curved portions, a hill portion 616 at the central portion thereof and guiding paths 617, 617 positioned between the hill portion 616 and the elevated sides 615, 615 for guidng the player separately at right and left sides of the hill portion 616.

Figure 19:
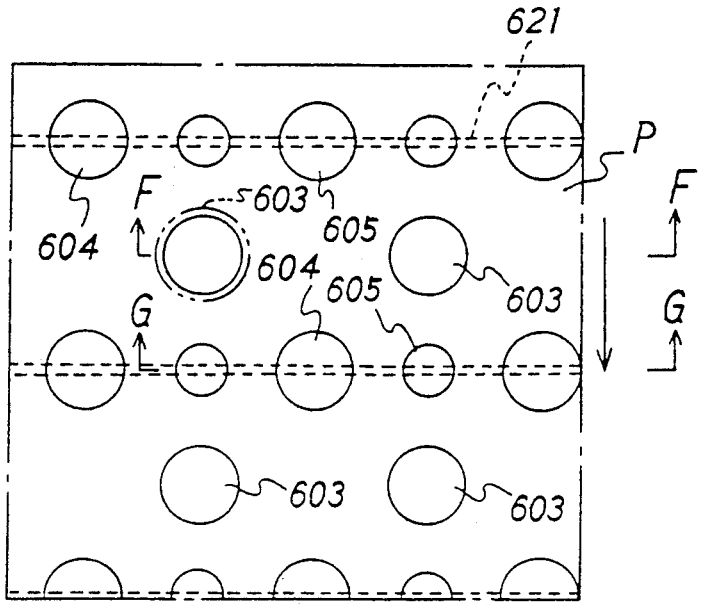
FIG. 19 is a view of assistance in explaining structures and arrangements of free balls and restricting balls respectively employed in the sixth embodiment.
Figure 20:
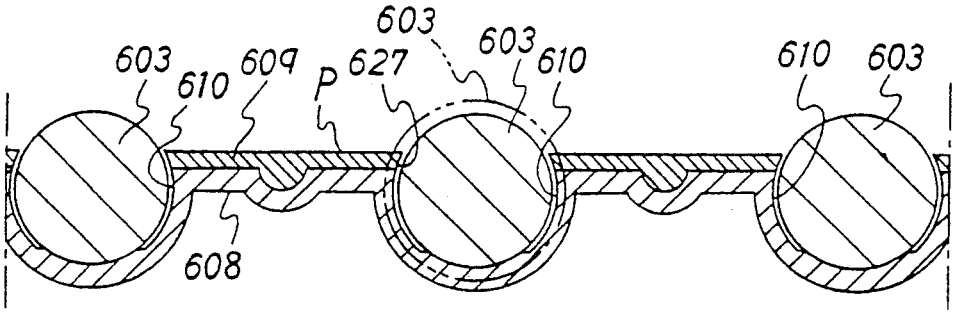
FIG. 20 is an enlarged cross section taken along F—F of FIG. 19.
Figure 21:
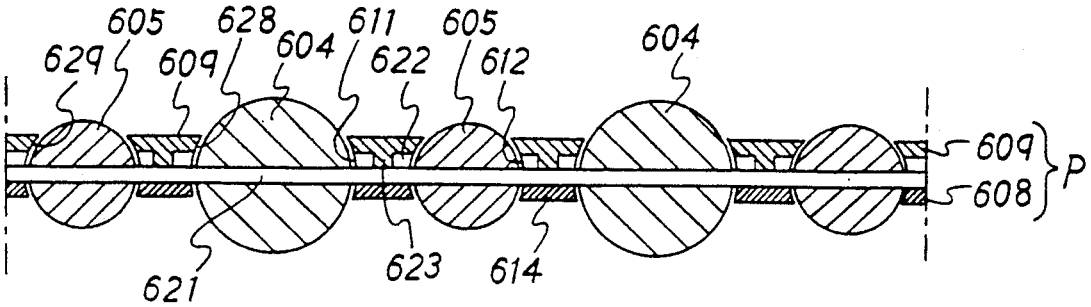
FIG. 21 is an enlarged cross section taken along G—G of FIG. 19.

The hill portion 616 has a play spot provided with no balls at the lower portion thereof on which the player can get rest. The substrate 608 made of rigid plastics has recesses 610 arranged regularly vertically and laterally for receiving the free balls 603 as illustrated in FIG. 19 and large and small ejecting holes 611, 612 alternately arranged between the recesses 610, 610 for receiving large and small restricting balls. Bearing portions 614 are provided between the large and the small ejecting holes 611, 612. The large ejecting holes 611 are arranged at the middle portion between the free balls 603, 603 while the small ejecting holes 612 are arranged on the same line as the free balls 603.

The large and the small restricting balls 604, 605 are supported relative to the large and the small ejecting holes 611, 612 in the manner that grooves 622 are defined on the substrate 608 for receiving shafts 621 each made of a stainless steel, and projections 623 are provided on the upper sheet 609 for pressing and fixing the shafts 621. The shafts 621 are bent at the curved portions 615, 615 of the descending plate P but straight at the portion through which the large and the small restricting balls 604, 605 insert.

The upper sheet 609 made of rigid or semi-rigid plastics is provided with spherical projecting edges 627, 628, 629 corresponding respectively to the recesses 610, and the large and the small ejecting holes 611, 612, and having diameters which are defined smaller than those of the respective balls 603, 604, 605 whereby the free balls 603 are prevented from getting out relative to the spherical projecting edges 617. The free balls 603 have the same diameters as the large restricting balls 604, and the small restricting balls 605 have diameters less than those of 603 balls, 604. Inasmuch as the free balls 603 having a height from the substrate higher than that of the small restricting balls 605, are arranged between the upper and the lower small restricting balls 605, the turning of the ski can be made by the free balls 603.

With the arrangement of the sliding device according to the first to fourth embodiments, there are the following advantages.

Inasmuch as the plurality of balls are rotatably arranged on the sliding surface of the slope, the player can descend on the slope while the balls are rotated. Generated between the ski and the balls is the rolling friction which produces less frictional heat whereby the ski is not likely to be damaged and the accelerating distance is reduced for thereby obtaining high speed from the beginning of descending action. Even if the descending speed is increased, the ski is not stemmed. Furthermore, the player can enjoy the skiing since there is unevenness due to the balls on the slope as if on the natural ski slope.

In addition to the first advantage set forth just above, there is a second advantage according to the second embodiment. That is, at the time of traversing of the ski, the balls having small diameters receive the ski in the auxiliary manner so that the player can enjoy smooth sliding on the slope whereby there is an advantage that the ski can be turned with ease from the schussing to the traversing and vice versa as if it were made on the natural snow slope.

In addition to the first advantage, there is a third advantage according to the third embodiment. That is, inasmuch as the ski can slide mainly on the large balls and the middle and the small balls are structured to resist to the ski sliding to some extent, the sliding speed can be restricted. Furthermore, inasmuch as the large and the middle balls can be formed in the pyramidal arrangement similar to the snow crystal in the artificial ski slope, the player can feel as if he were sliding on the natural snow slope.

In addition to the first advantage, there is a fourth advantage according to the fourth embodiment. That is, inasmuch as the structure of the balls can be formed in the semi-pyramidal structure, namely, the middle balls are arranged around the large balls in the manner that the height of each middle ball exposed from the substrate is less than that of each large ball which serves as the apex so that the artificial ski slope can be structured as if the player felt the sliding on the natural snow slope.

There is a fifth advantage according to the fifth embodiment. That is, since large and middle size balls are arranged appropriately and differentiated in the height thereof from the substrate, the large balls mainly contact the slope for carrying out sliding and the middle balls contact the slope in the auxiliary manner in the case that the ski etc. receives a shock or is turned to a different direction so that the player can enjoy the peculiar feeling. Furthermore, the structure of the artificial slope is simple for thereby involving low cost in the installation thereof and the maintenance thereof. Still furthermore, the stability, free sliding direction, and high cushion can be obtained in any of the ski, the sleigh and the skate board so that the player can comfortably enjoy the sliding.

There is a sixth advantage according to the sixth embodiment. That is, since the ski and the like can slide on the slope by the rotation of the balls, it is possible to obtain the descending speed even on a gentle slope and prevent the end of the wear from being caught in the rollers with the rotation of the balls to assure the safe sliding. Furthermore, since the balls have no cornered portions the player can make a comfortable sliding without vibrating laterally. The player can freely turn because of the free balls and the slope is designable to have curved portions in the width direction without cornering at the curved portions.

Although the invention has been described in its preferred form with a certain degree of particularity, it is to be understood that many variations and changes are possible in the invention without departing from the scope thereof.

What is claimed is:

1. A sliding device, comprising:

a sheet-like substrate;

means defining a plurality of uniformly arranged first recesses in a surface of said substrate;

means defining a plurality of second recesses in said substrate surface, said second recesses being arranged peripherally around said first recesses, said second recesses being smaller than said first recesses;

a plurality of first balls each having a first diameter, each said first ball being received and engaged in one of said first recesses and rotatable in all directions;

a plurality of second balls each having a second diameter, each said second ball being received and engaged in one of said second recesses and rotatable in all directions; and said second diameter of said second balls being smaller than said first diameter of said first balls, said first and second balls projecting from said recesses beyond said substrate surface, and said first balls projecting further beyond said substrate surface than said second balls.

2. A sliding device according to claim 1, including means for retaining said balls in said recesses.

3. A sliding device according to claim 2, wherein said first diameter is significantly greater than said second diameter.

4. A sliding device according to claim 2, wherein each of said first balls and the associated second balls as arranged peripherally therearound define a pyramidal structure on said substrate with said first ball defining an apex of said pyramidal structure.

5. A sliding device according to claim 2, wherein outer surfaces of said balls frictionally engage inner surfaces of said recesses over a frictional contact area during rotation of said balls in said recesses, said frictional contact area as associated with said first balls being substantially smaller than the inner surface of said first recesses so that the frictional resistance associated with said first balls is less than the frictional resistance associated with said second balls.

6. A sliding device comprising:

a sheet-like substrate;

means defining a plurality of first and second recesses of respectively different sizes in a surface of said substrate, said first and second recesses being arranged in a uniform pattern on said substrate, and said first recesses being larger than said second recesses;

means defining a plurality of third recesses in said substrate surface, said third recesses being smaller than said first and second recesses and being arranged peripherally around said first and second recesses; and a plurality of first, second and third balls having respective first, second and third diameters, said first diameter being larger than said second diameter, said second diameter being larger than said third diameter, said first, second and third balls being respectively received and engaged in said first, second and third recesses and rotatable in all directions, outer surfaces of said balls frictionally engaging inner surfaces of said recesses to yieldably frictionally resist rotation of said balls in said recesses, said frictional resistance associated with said first balls being less than said frictional resistance associated with said second and third balls, whereby said first balls are adapted to rollingly support a ski for movement relative to said substrate while said second and third balls provide relatively greater yieldable resistance against such ski movement.

7. A sliding device according to claim 6, wherein said second balls are made of a semi-rigid plastics material to provide greater rotational frictional resistance of the second balls within the respective second recesses.

8. A sliding device for use as a ski, comprising:

a body having a substrate fixedly mounted thereon, said substrate having a surface which faces oppositely of said body;

means defining a plurality of first and second recesses in said substrate surface, said second recesses being smaller than said first recesses and arranged peripherally around each of said first recesses; and a plurality of first and second balls having respective first and second diameters and being respectively received and rotatably engaged in said first and second recesses, said second diameter being smaller than said first diameter, and said first and second balls projecting from said recesses beyond said substrate surface by respectively different amounts.

9. A sliding device, comprising:

a vertically sloping sheet-like substrate with a sliding surface defined thereon;

means defining a plurality of recesses in said sliding surface;

a plurality of first balls rotatably received and engaged in said recesses for rotation in all directions;

means defining an elongate groove in said substrate, said elongate groove extending transversely relative to a sloping direction of said substrate, said substrate having a plurality of holes extending therethrough, said holes being contiguous with said groove, said groove opening into opposite sides of each said hole;

an elongate shaft received in said transverse groove and extending through and across each of said holes; and a plurality of further balls supported on said shaft within said holes for rotation relative to said substrate about a transverse axis defined by said shaft.

* * * * *